US009601098B2

(12) United States Patent
Black Hawk

(10) Patent No.: US 9,601,098 B2
(45) Date of Patent: Mar. 21, 2017

(54) MULTIPLE INSTRUMENT TUNER SYSTEM

(71) Applicant: Dory Black Hawk, Fort Worth, TX (US)

(72) Inventor: Dory Black Hawk, Fort Worth, TX (US)

( * ) Notice: Subject to any disclaimer, the term of this patent is extended or adjusted under 35 U.S.C. 154(b) by 0 days.

(21) Appl. No.: 14/693,606

(22) Filed: Apr. 22, 2015

(65) Prior Publication Data

US 2016/0314773 A1 Oct. 27, 2016

(51) Int. Cl.
*G10H 1/44* (2006.01)
*G10G 7/00* (2006.01)

(52) U.S. Cl.
CPC ..... *G10H 1/44* (2013.01); *G10G 7/00* (2013.01)

(58) Field of Classification Search
CPC ..... G10H 1/44; G10G 7/00
USPC ..... 84/454
See application file for complete search history.

(56) References Cited

U.S. PATENT DOCUMENTS 4,909,126 A 3/1990 Skinn
5,877,443 A * 3/1999 Arends ..... G10G 7/02 84/454
7,560,634 B2 * 7/2009 Miyazawa ..... G10H 1/06 84/454
8,742,242 B1 * 6/2014 Ribner ..... G10G 7/02 84/454
2007/0169612 A1 * 7/2007 Miyazawa ..... G10H 1/06 84/423 R
2008/0036915 A1 * 2/2008 Nagakura ..... G10G 7/02 348/569
2010/0212475 A1 * 8/2010 Toulson ..... G01H 3/08 84/454
2011/0197743 A1 * 8/2011 Potter ..... G10G 7/02 84/730
2012/0067192 A1 * 3/2012 Nielsen ..... G10G 7/02 84/454

(Continued)

FOREIGN PATENT DOCUMENTS

JP 2008233735 A 2/2008
JP 2013242440 A 5/2013

OTHER PUBLICATIONS

US 5,877,442, 03/1999, Freeland (withdrawn)
U.S. Appl. No. 13/184,009, filed Sep. 27, 2012, Bjornson.
U.S. Appl. No. 14/013,041, filed May 22, 2014, Yui.

*Primary Examiner* — David Warren
(74) *Attorney, Agent, or Firm* — Law Office of Jeff Williams; J. Oliver Williams

(57) ABSTRACT

The present application includes a system configured to tune multiple instrument simultaneously. The system includes a plurality of frequency sensors, each in communication with a single instrument. The frequency sensor senses a pitch played from the respective instrument and transmits that pitch frequency to a single tuner for processing. The tuner compares each pitch frequency to a base reference. The base reference for each instrument may be different depending on the pitch played by the instruments. The pitch frequency is compared to the base reference and a deviation is produced. The deviation is transmitted and displayed on a readout for use by the musician to make adjustments to the instrument based upon the deviation. An additional readout is also provided to a third party operator for viewing.

7 Claims, 2 Drawing Sheets

(56) References Cited

U.S. PATENT DOCUMENTS

| | | | | |
|---|---|---|---|---|
| 2012/0240749 | A1* | 9/2012 | Bjornson | G10G 7/02 84/454 |
| 2014/0041509 | A1* | 2/2014 | Seno | G10G 7/02 84/454 |
| 2014/0137720 | A1* | 5/2014 | Yui | G10G 7/02 84/454 |

* cited by examiner

MULTIPLE INSTRUMENT TUNER SYSTEM

BACKGROUND

1. Field of the Invention

The present application relates generally to music instrument tuning devices and, more particularly, to a system for tuning multiple instruments simultaneously.

2. Description of Related Art

Tuning is the process by which an artist adjusts the pitch of one or more tones from a musical instrument to establish typical intervals between those tones. This is done usually based on a fixed reference or standard. Instruments become in need of tuning over time from damage or use and need to be re-tuned.

Tuning is typically done for an instrument against the standard fixed reference. When one instrument is playing alone, no discrepancies are noted. Tuning devices exist to tune one or more strings of a stringed instrument or to tune each string individually. However, often musical instruments are played together. This is seen often in a band where multiple guitarists are featured. Usually each guitarist tunes his own instrument against a preferred fixed reference. But conditions may exist where the guitars are tuned to a slightly different tuner. At times a tuner would be shared, but this can take extra time to tune, working with the sound crew one by one.

It is desirable to provide a system configured to tune multiple string instruments simultaneously, so as to save time and gain more closely tuned instruments. Although great strides have been made, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
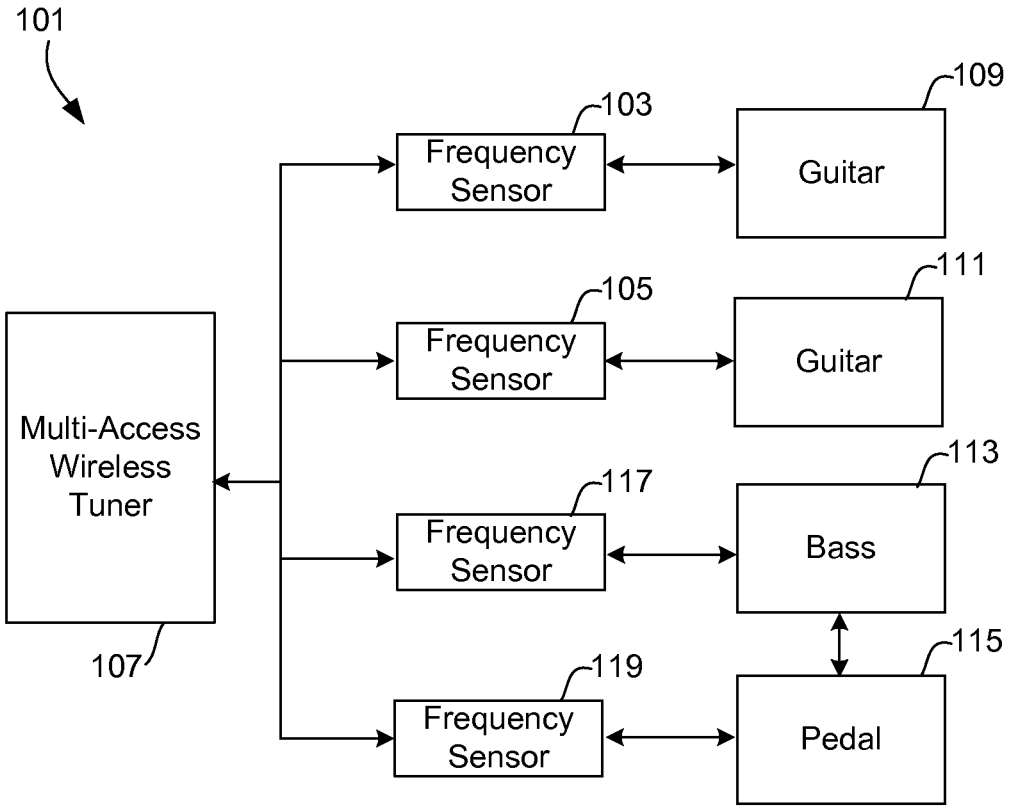
FIG. 1 is a chart of a multiple instrument tuner system according to the preferred embodiment of the present application.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The system in accordance with the present application overcomes one or more of the above-discussed problems commonly associated with conventional tuners and tuning methods. Specifically, the system of the present application is configured to receive and process the pitch frequencies of multiple instruments simultaneously and compare each to a respective base reference within a single tuner. The tuner generates a deviation for each pitch frequency and transmits the pitch frequencies to the respective instrument for tuning by the musician. The tuner is also configured to display the respective deviation on a remote display for each instrument to permit a third party user to view the deviations of each instrument. By permitting the tuning of multiple instruments from a single tuner, the accuracy and synchronization of the instruments is improved as well as the time necessary to tune the instruments is decreased. These and other unique features of the system are discussed below and illustrated in the accompanying drawings.

The system will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The multiple instrument tuner system of the present application is illustrated in the associated drawings. The assembly includes a first and second frequency sensor configured to each detect and transmit sound frequencies from an instrument. The assembly also includes a tuner capable of receiving the frequencies from each sensor and processing and comparing them against a base reference at the same at the same time. The tuner of the present application is configured to transmit deviation data for to each frequency sensor corresponding to the pitch frequency generated by the instrument.

Referring now to the drawings wherein like reference characters identify corresponding or similar elements in form and function throughout the several views. FIG. 1 in the drawings illustrate a chart of a multiple instrument tuner system 101 according to the preferred embodiment of the present application. System 101 includes a first frequency sensor 103 and a second frequency 105 sensor in communication with a multi-access wireless tuner 107. Each frequency sensor 103 and 105 are in communication with an instrument 109 and 111 respectively. Readout displays are included on sensors 103, 105 and tuner 107 to convey to a musician or operator information necessary to tune instruments 109 and 111.

Frequency sensors 103 and 105 are configured to sense the pitch of one or more tones played from instruments 109 and 111 respectively, and transmit the pitch frequency to tuner 107. Sensors 103 and 105 may be any type of sensor configured to measure frequency, such as a microphone or vibration sensor. Additionally sensors 103 and 105 may be coupled directly to instruments 109 and 111 or be set up adjacent to them.

Tuner 107 is configured to communicate with a plurality of sensors (i.e. sensors 103 and 105) simultaneously. Tuner 107 receives the pitch frequencies from sensors 103 and 105 for processing. Tuner 107 compares each frequency to a base reference frequency and determines a level of deviation from that base reference. The frequency deviation is determined and then transmitted back to one or more users or musicians for review and to make adjustments to each instrument 109 and 111 so as to bring the instruments 109 and 111 into tune. Instruments 109 and 111 are simultaneously in communication with tuner 107 and can simultaneously tune the same or different notes, pitches, chords, and so forth. An advantage of tuner 107 is that time is saved by the combined tuning of a plurality of instruments and that the instruments are all tuned based off a single base reference to ensure accuracy.

As seen in FIG. 1, a third instrument 113 is in communication with tuner 107. Instrument 113 is also in communication with a pedal 115. Pedal 115 and instrument 113 both are configured to communicate with tuner 107 in a manner similar in form and function to that described with respect to instruments 109 and 111. Each is in communication with its own frequency sensor 117 and 119 respectively. In this scenario, pedal 115 is used with instrument 113. Pedal 115 is an additional piece of equipment used to assist instrument 113 in making music. System 101 is able to tune and communicate with various types of equipment functioning with various types of instruments in order to produce a proper sound.

Although tuner 107 has been described as simultaneously processing one or more tones from a plurality of instruments, it is understood that tuner 107 may be in communication with sensors 103 and 105 simultaneously thereby receiving pitch frequencies at different times between the instruments; be receiving a pitch frequency played from each of the instruments of the same tone simultaneously for processing; and/or be receiving a pitch frequency from each of the instruments simultaneously wherein each instrument is tuning a different frequency or note. Additionally, it is understood that instruments described may be any one of sting instruments, wind instruments, and percussion instruments. Tuner 107 is able to tune sound generated from individual instruments of a band or orchestra at the same time and assist to harmonize the sound generated by the collective body of instruments. Lastly, it is understood that communication between the sensors, instruments, equipment, and tuner are done wirelessly, however, it is contemplated that in some embodiments a wired connection may be used.

Figure 2:
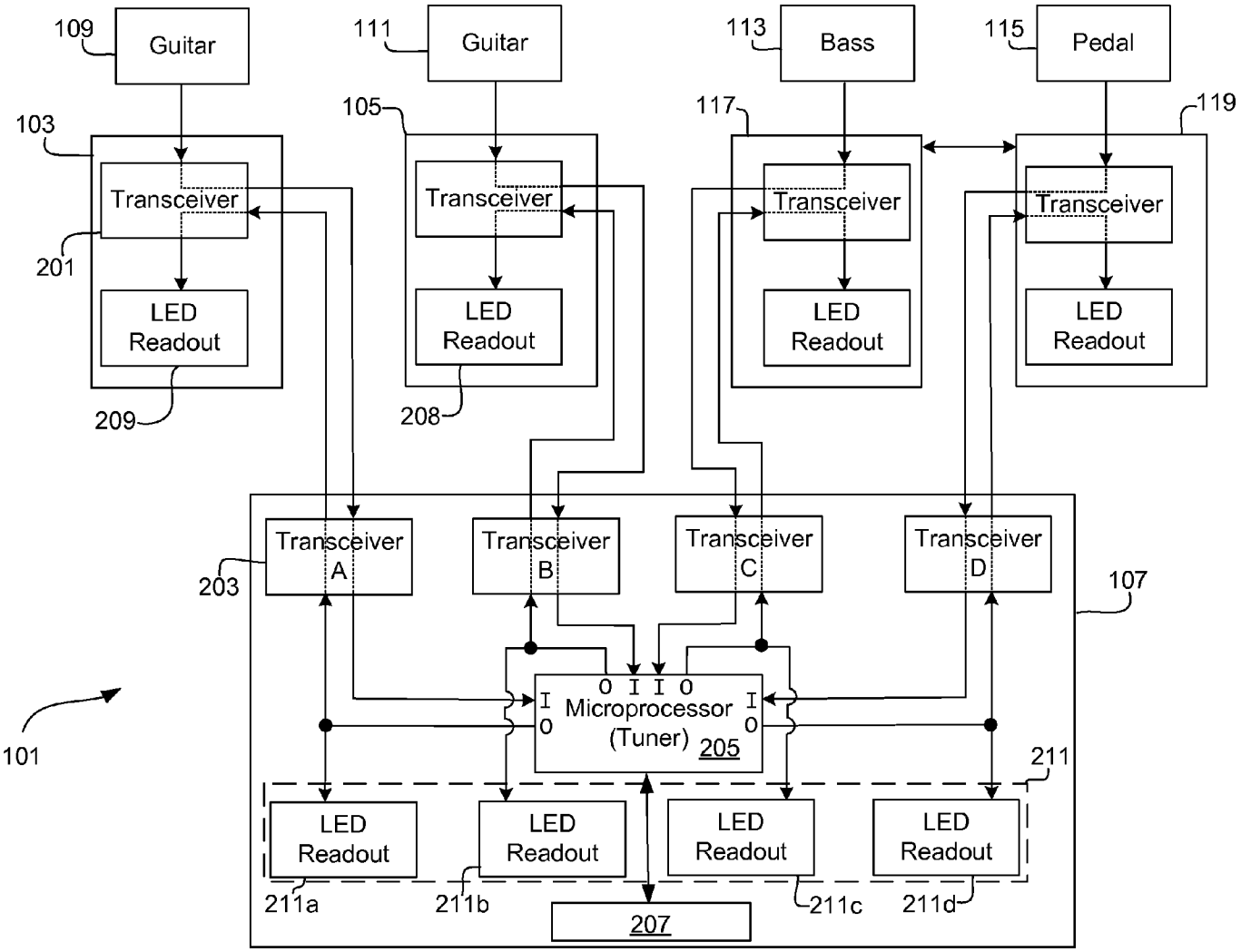
FIG. 2 is a detailed chart of the multiple instrument tuner system of FIG. 1.

Referring now also to FIG. 2 in the drawings, a detailed chart of system 101 is illustrated. FIG. 2 illustrates some of the basic architecture for communicating between sensors 103, 105, 117, 119 and that of tuner 107. For simplicity, the communication process will be described in relation to instrument 109, sensor 103 and tuner 107. The other sensors and instruments are configured to communicate with tuner 107 in a manner similar in form and function to that herein described.

Sensor 103 is configured to detect, process, and transmit the frequency of one or more tones selectively played by instrument 103. A transceiver 201 is used to transmit the pitch frequency to tuner 107. A corresponding transceiver 203 within tuner 107 receives the pitch frequency and passes it on to a microprocessor 205 for tuning and processing. A control panel 207 is also in communication with microprocessor 205 and is used to permit an operator or sound crew member to designate the base reference to be used when analyzing the pitch frequency received from instrument 109. Tuner 107 has a plurality of preset base references for the one or more tones playable by the instruments for proper tuning. Microprocessor 205 compares the pitch frequency from the instrument 109 to that of the selected base reference, as selected from control panel 207. A deviation in the pitch frequency is determined and then communicated back out from microprocessor 205 to one or more readouts.

System 101 is configured to provide the user playing the instrument and the operator of tuner 107 (i.e. a sound crew member) notification of the deviation in the pitch frequency for each instrument. Sensor 103 receives the deviation displayed on a readout 209. Tuner 107 also is configured to display the deviation on a readout 211. Multiple readouts for the operator of tuner 107 and the player of instrument 109 are useful to permit better communication between the artist and the crew.

Readout 211 may be a single display configured to independently provide the pitch deviations of each instrument in communication with tuner 107. Therefore a single display readout 211 may be used. Readout 211 may be coupled to tuner 107 or may be located remote to tuner 107. Other embodiments may utilize separate individual display readouts 211*a-d*. Either way, readouts 211, 211*a-d* are configured to display the deviations of frequency for each individual instrument to assist in the tuning of each individual instrument. For example, readouts 211*a* and 209 may show the frequency deviation for the one or more tones played by instrument 109, while readouts 211*b* and 208 show the frequency deviation for the one or more tones played by instrument 111.

System 101 is fairly simple to operate. A frequency sensor is first associated with one or more instruments for the simultaneous tuning of such instruments. The instruments may tune the same or different tones at the same time or may vary deviate from one another. The control panel 207 is used to designate the base reference for each instrument for the microprocessor to compare to. The instrument plays a tone which is detected by the frequency sensor. A first pitch frequency is generated and transmitted to the tuner. The pitch frequency is received and processed in the microprocessor and compared to the selected base reference. The deviation is determined and transmitted for display on one or more readouts for use by one or more operators (i.e. musician and crew member) to make necessary adjustments to tune each instrument. The process is repeated until the pitch frequency is within a prescribed harmony with the base reference.

The current application has many advantages over the prior art including at least the following: (1) time is saved by the combined tuning of a plurality of instruments; (2) instruments are all tuned based off a single base reference to ensure accuracy; and (3) selection of multiple base references to compare with a pitch frequency.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A method of tuning a plurality of instruments, comprising:

associating a first frequency sensor with a first instrument, the first frequency sensor configured to transmit a first pitch frequency as played from the first instrument;

associating a second frequency sensor with a second instrument, the second frequency sensor configured to transmit a second pitch frequency as played from the second instrument;

generating a first pitch frequency and a second pitch frequency;

processing the first pitch frequency and a second pitch frequency within a single tuner simultaneously, the first pitch frequency and a second pitch frequency being compared to a base reference;

transmitting a deviation of the first pitch frequency and a second pitch frequency back to the first frequency sensor and the second frequency sensor respectively, the deviation being illustrated on a readout within each respective frequency sensor; and adjusting the pitch of the first instrument based upon the displayed deviation shown on the first frequency sensor.

2. The method of claim 1, further comprising:

displaying the deviation of the first frequency and the second frequency on a remote display.

3. The method of claim 1, wherein the tuner is configured to tune multiple instruments simultaneously with a single tuner.

4. The method of claim 1, wherein the tuner includes a microprocessor to receive frequency signals and transmit the deviation for each instrument to the respective frequency sensor.

5. The method of claim 1, wherein the tuner is configured to process the pitch frequency of multiple instruments to a single base reference simultaneously.

6. The method of claim 1, wherein the tuner is configured to process multiple pitch frequencies from multiple instruments simultaneously.

7. The method of claim 1, further comprising:

selecting the base reference from a control panel in communication with the tuner, the tuner comparing the first pitch frequency and the base reference to generate the deviation.

* * * * *